US007134307B2

(12) United States Patent
Honjo et al.

(10) Patent No.: US 7,134,307 B2
(45) Date of Patent: Nov. 14, 2006

(54) PLATE ROLLING MILL

(75) Inventors: Hisashi Honjo, Chiyoda-ku (JP); Takayuki Iwasaki, Chiyoda-ku (JP)

(73) Assignee: Ishikawajima-Harima Heavy Industries Co., Ltd., Tokyo (JP)

( * ) Notice: Subject to any disclaimer, the term of this patent is extended or adjusted under 35 U.S.C. 154(b) by 22 days.

(21) Appl. No.: 10/886,088

(22) Filed: Jul. 8, 2004

(65) Prior Publication Data

US 2005/0028575 A1 Feb. 10, 2005

(30) Foreign Application Priority Data

Aug. 4, 2003 (JP) ..... 2003-286008

(51) Int. Cl.
*B21B 29/00* (2006.01)

(52) U.S. Cl. ..... 72/243.6; 72/247

(58) Field of Classification Search ..... 72/243.6, 72/247, 241.8, 242.2, 242.4, 241.2
See application file for complete search history.

(56) References Cited

U.S. PATENT DOCUMENTS 4,369,646 A * 1/1983 Kajiwara ..... 72/241.8
4,596,130 A * 6/1986 Yoshii et al. ..... 72/243.6
4,784,051 A * 11/1988 Hauslein ..... 99/307
5,131,252 A * 7/1992 Turley et al. ..... 72/242.4
5,622,073 A * 4/1997 Hiruta et al. ..... 72/247
6,151,943 A * 11/2000 Nihei et al. ..... 72/241.2
6,374,656 B1 * 4/2002 Donini et al. ..... 72/241.8

FOREIGN PATENT DOCUMENTS

| | | |
|---|---|---|
| JP | 03-230802 | 10/1991 |
| JP | 5-13726 | 2/1993 |
| JP | 2004-098074 | 4/2004 |

* cited by examiner

*Primary Examiner*—Derris H. Banks
*Assistant Examiner*—Teresa M Bonk
(74) *Attorney, Agent, or Firm*—Griffin & Szipl, P.C.

(57) ABSTRACT

A plate rolling mill includes a pair of work rolls that hold and press down a plate material therebetween, a plurality of backup rolls that prevent the work rolls from being deformed, and intermediate rolls each of which is disposed between the work roll and the backup roll so as to be shiftable. Each of the intermediate rolls has a contact roll portion that contacts with the backup roll, and an extension barrel portion that is connected to an end of the contact roll portion and does not contact the backup roll at any shifted position. The contact roll is formed to have a convex shape such that a convex center of the contact roll is positioned at a side of the extension barrel portion.

8 Claims, 6 Drawing Sheets

PLATE ROLLING MILL

BACKGROUND OF THE INVENTION

This application claims priority from Japanese Patent Application No. 2003-286008, filed Aug. 24, 2003, the entire disclosure of which is incorporated herein by reference.

1. Technical Field of the Invention

The present invention relates to a plate rolling mill that presses down a plate material between work rolls.

2. Description of the Related Art

With a plate rolling mill that presses down a plate material between a pair of work rolls that hold the material, the lateral distribution of the thickness of the material rolled is required to be controlled to have a convex or concave section, thereby having a predetermined plate crown, even under varied conditions.

Patent literature 1 has already been disclosed and Patent literature 2 (not published yet) has been applied to control a plate crown such as that described above.

The "rolling mill" of Patent literature 1 is shown in FIG. 1; a pair of rolls 51 with roll crowns having diameters that vary over the entire lengths of the roll barrels are disposed, wherein the aforementioned roll crowns are formed to make both roll barrel profiles convex, and their maximum-diameter portions 53 are shifted from the width-wise centerlines 52 of both rolls, in the axial directions of the rolls; that is, each shape of the rolls is located asymmetrically about the axis 52; in addition, the above-mentioned rolls are configured to be movable in the axial direction thereof.

In "Mill rolls and mill using them" of Patent literature 2 shown in FIG. 2, mill rolls (in this example, intermediate rolls 63) are formed with four shaped-portion ranges; i.e., an extension barrel portion A composed mainly of a small-diameter portion that does not contact reinforcement roll 64 at any shift location, a cylinder roll portion B that is in contact with the reinforcement roll, a decrement portion C, whose diameter gradually decreases from the end of the cylinder roll portion, and an increment portion D, whose diameter gradually increases from the end of the decrement portion. The shapes of these portions A, B,C and D are expressed by a sixtic-functional curve defined by 7 points, from one end to the other of a roll axis. In FIG. 2, 62 represents the work rolls.

[Patent Literature 1]

Japanese Patent Publication No. 5-13726, 1993

[Patent Literature 2]

Specification of Japanese Patent Application No. 259629, 2002 "Mill rolls and mill using them," not published yet The mill of Patent literature 1 presents rolls that cannot be easily shifted during a rolling operation, because the rolls receive a rolling load.

A problem with the mill of Patent literature 2 is that the shapes of intermediate shift rolls are not effective for forming a plate crown into the concavity shown in FIG. 3B because the intermediate shift roll is concave, although the rolls can effectively form the convex plate crown shown in FIG. 3A.

SUMMARY OF THE INVENTION

The present invention aims to solve the aforementioned problems. That is, an object of the present invention is to provide a plate rolling mill that can effectively control a lateral distribution of a thickness of a plate material so as to make the plate material concave in the lateral section thereof, and can easily shift rolls during a rolling operation.

According to the present invention, there is provided a plate rolling mill comprising: a pair of work rolls that hold and press down a plate material therebetween; a plurality of backup rolls that prevent the work rolls from being deformed; and intermediate rolls each of which is disposed between the work roll and the backup roll so as to be shiftable, characterized in that each of the intermediate rolls comprises: a contact roll portion that contacts with the backup roll; and an extension barrel portion that is connected to an end of the contact roll portion and does not contact the backup roll at any shifted position, wherein the contact roll is formed to have a convex shape such that a convex center of the contact roll is positioned at a side of the extension barrel portion.

According to a preferred embodiment of the present invention, the plate rolling mill further comprises work roll bending means for applying a bending moment to both ends of the work rolls.

Preferably, the plate rolling mill further comprises work roll bending means for applying a bending moment to both ends of the intermediate rolls.

Preferably, the intermediate rolls are intermediate rolls for a six-roll mill or a cluster mill. The six-roll mill is a plate rolling mill that has six rolls.

According to the above-mentioned configuration of the present invention, because intermediate rolls are composed to be shiftable, a crown shape can be controlled by shifting intermediate rolls without shifting work rolls, so a rolled plate is scarcely flawed.

In addition, because the contact roll is formed to have a convex shape such that a convex center of the contact roll is positioned at a side of the extension barrel portion, the plate can be easily controlled to have the convex crown by shifting the convex centers of these upper and lower intermediate rolls closer together.

Furthermore, as the embodiment is provided with an extension barrel portion that is connected to one end of the contact roll portion and does not contact a backup roll at any shifted position, a plate crown caused by the bending of rolls can be effectively controlled during rolling. Therefore, a basic setting is made by presetting the shift position of the intermediate rolls, and during rolling, the plate crown of the plate is controlled by the bending of the rolls. Thereby, it is possible to cope with plate crown variations during rolling.

Other objects and advantages of the present invention are described below, referring to the attached drawings.

DESCRIPTION OF THE PREFERRED EMBODIMENTS

Figure 1:
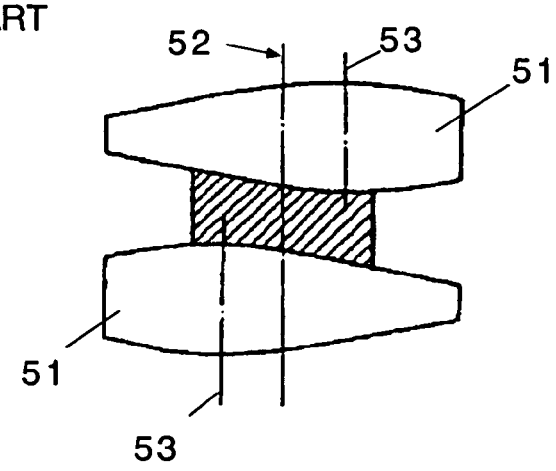
FIG. 1 PRIOR ART
FIG. 1 is a schematic view of the "rolling mill" according to Patent literature 1.
Figure 2:
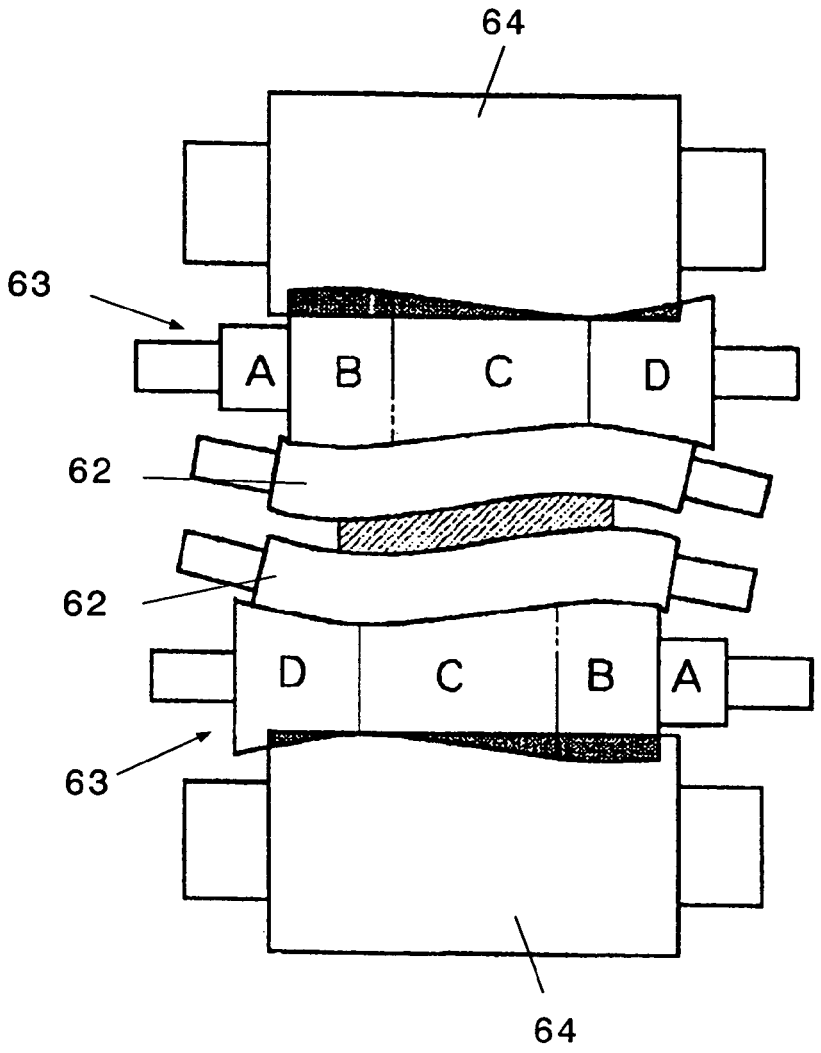
FIG. 2 PRIOR ART
FIG. 2 is a schematic view of "Mill rolls and mill using them" of Patent literature 2.
Figure 3A:
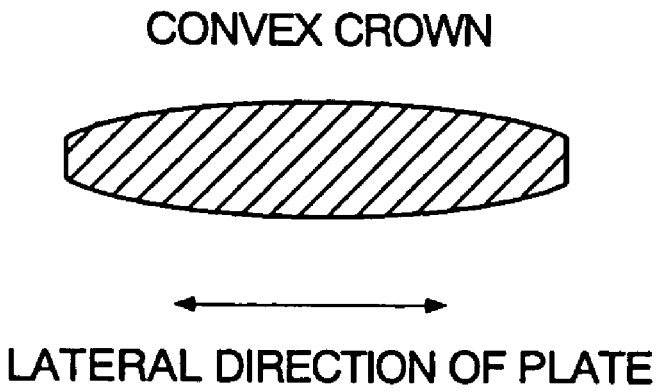
FIG. 3A is an illustration of a convex crown.
Figure 3B:
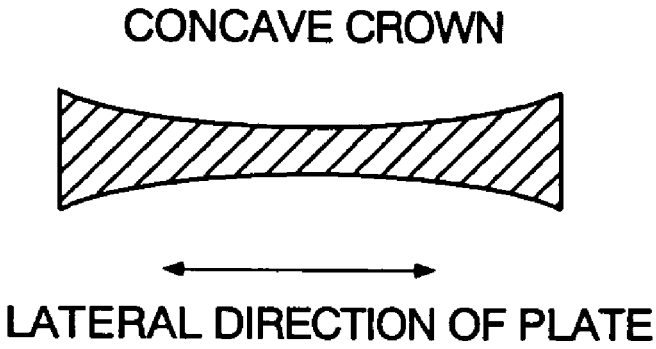
FIG. 3B is an illustration of a concave crown.

Preferred embodiments of the present invention are described below with reference to the drawings. Common components and parts in the drawings are identified by the same numbers, and no duplicate description is given.

Figure 4A:
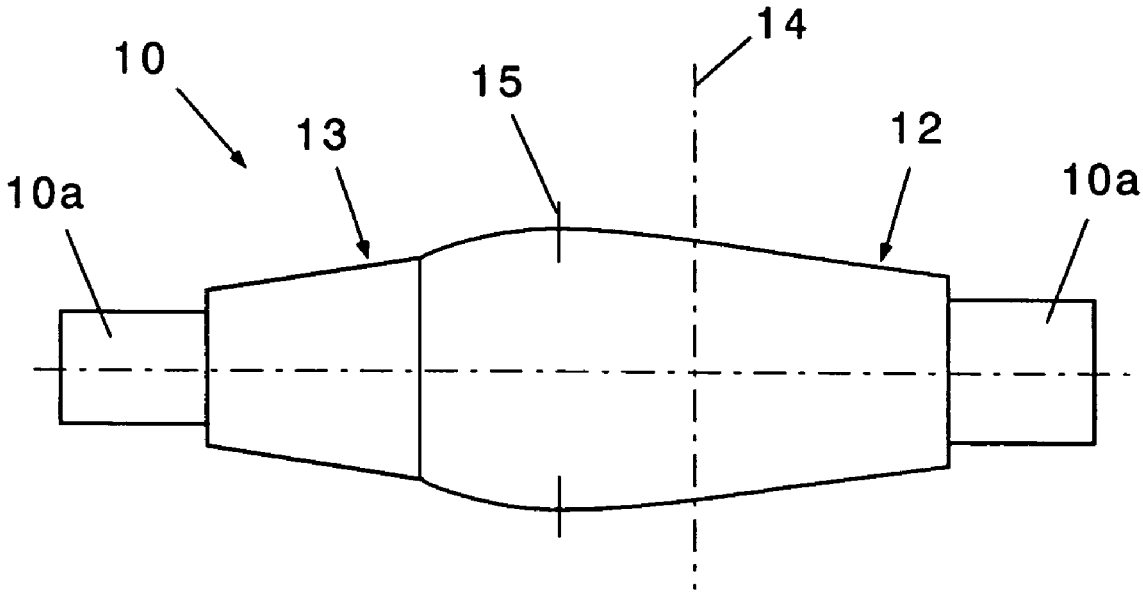
FIGS. 4A and 4B are side views of intermediate rolls that constitutes a plate rolling mill according to the present invention.
Figure 4B:
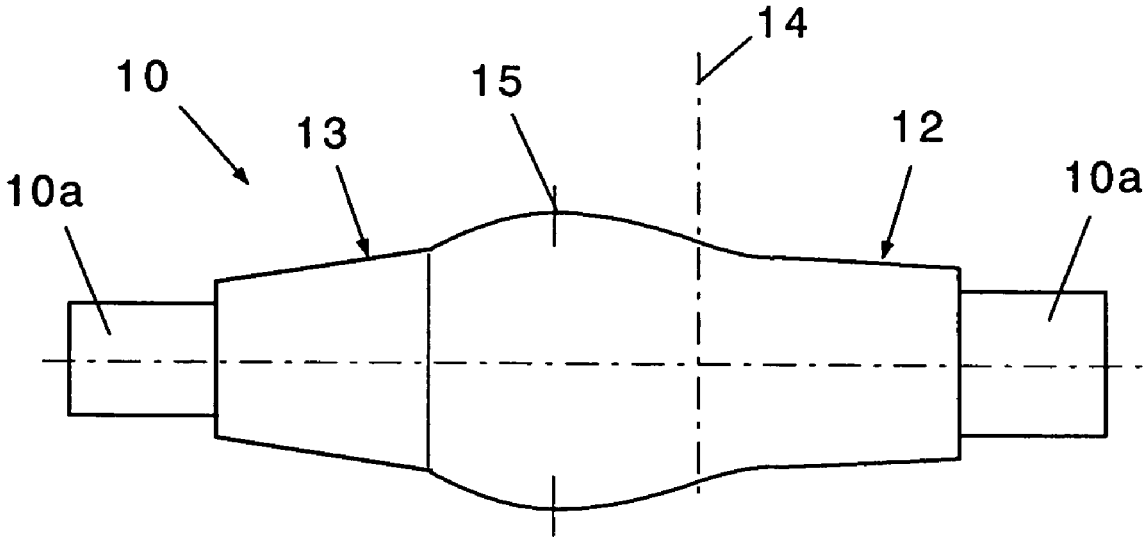

FIGS. 4A and 4B are side views of the intermediate rolls that constitute the plate rolling mill according to the present invention. FIGS. 4A and 4B relate to rolls with slightly different profiles, but both basic constructions are the same.

Intermediate rolls 10 in FIGS. 4A and 4B are provided with contact roll portions 12 and extension barrel portions 13 that are arranged in series between supporting shafts 10*a* at both ends.

The contact roll portion 12 has a convex profile with a convex center 15 at the side of the extension barrel, in which at least in part always contacts the back-up roll.

Figure 5:
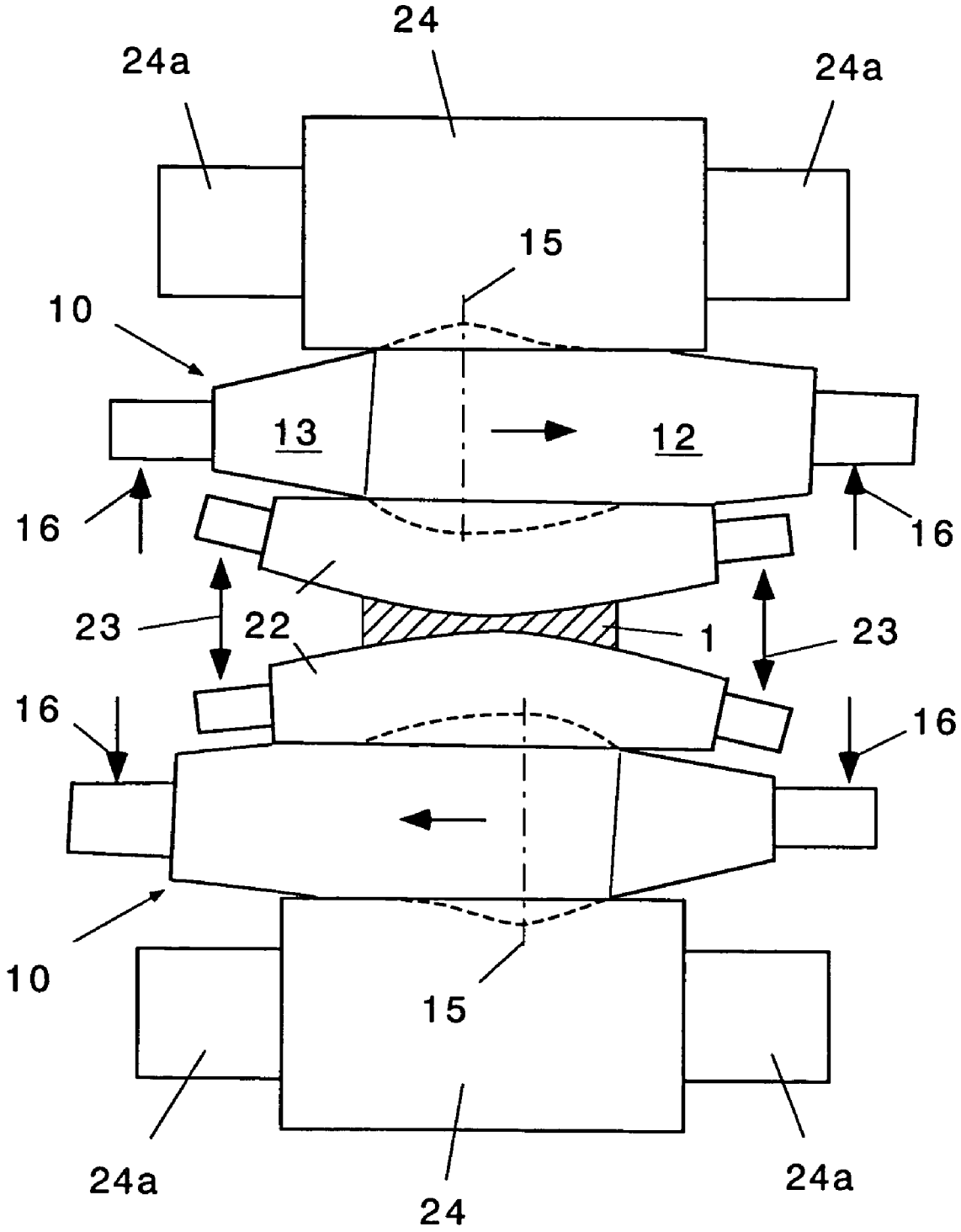
FIG. 5 shows an entire configuration of a first embodiment of the plate rolling mill according to the present invention.
Figure 6:
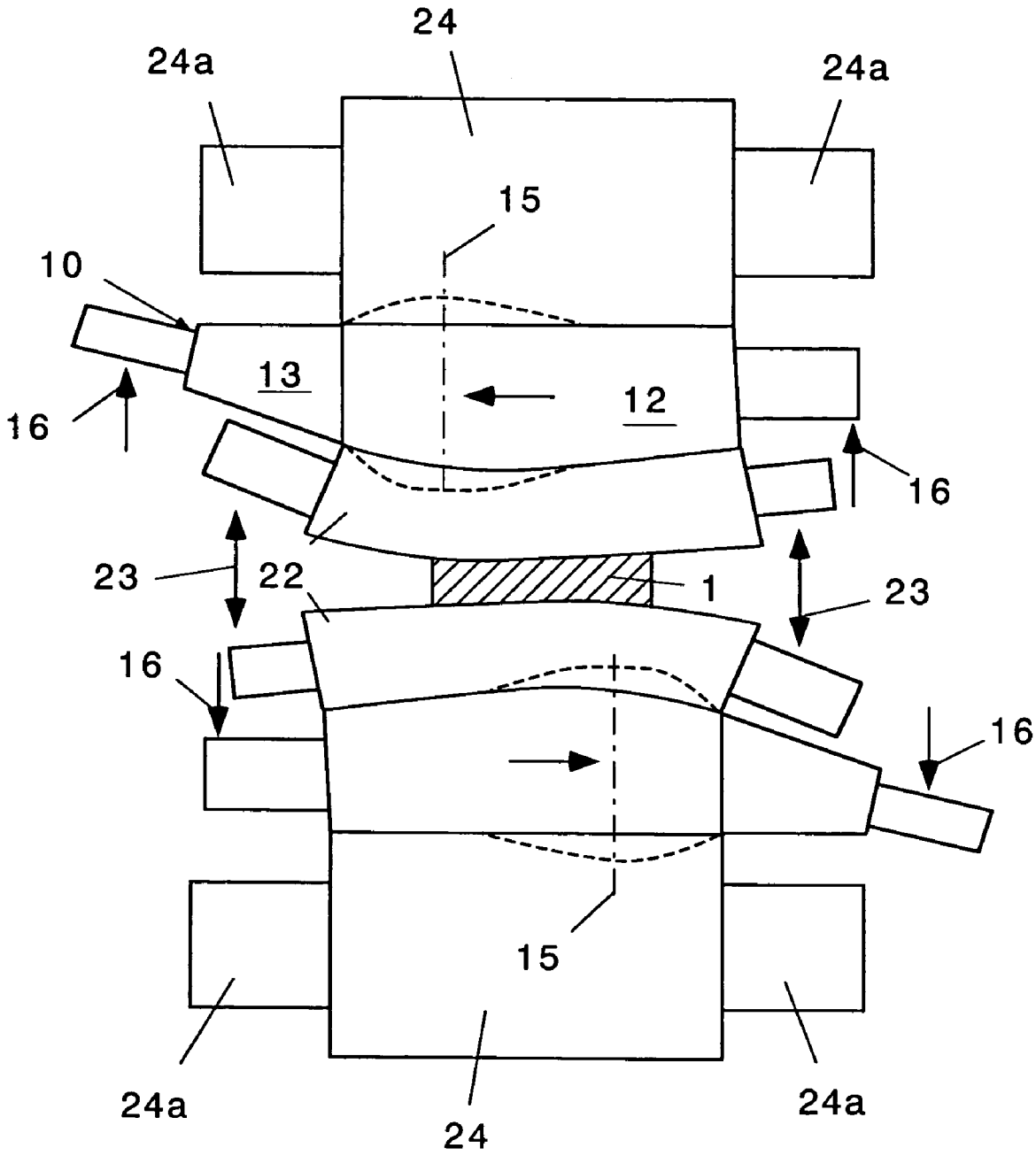
FIG. 6 shows another usage state of the plate rolling mill in FIG. 5.

The extension barrel portion 13 is connected to one end of the contact roll portion 12 at the side close to convex center 15, and is profiled so as not to come into contact with the backup roll 24, when the intermediate roll 10 is shifted, at any shifted location as shown in FIGS. 5 and 6. The profile of extension barrel portion 13 is, in this example, a truncated cone, but it may also be a cylinder, for instance. In these FIG., 14 represents the lateral center axis of the contact roll portion. As shown in FIGS. 5 and 6, the extension barrel portion 13 that is connected to an end of the contact roll portion 12 is disposable so that a fraction thereof faces the backup roll 24 at at least one shifted position, and does not contact the backup roll 24 at any shifted position.

FIG. 5 is a general configuration view showing the first embodiment of the plate rolling mill according to the present invention. The plate rolling mill according to the present invention is provided with a pair of work rolls 22 that sandwich and press down a plate material (1) (rolled plate); a plurality of backup rolls 24 that control the deformation of work rolls 22; and, intermediate rolls 10 that are placed between and held by work rolls 22 and backup rolls 24.

Figure 7:
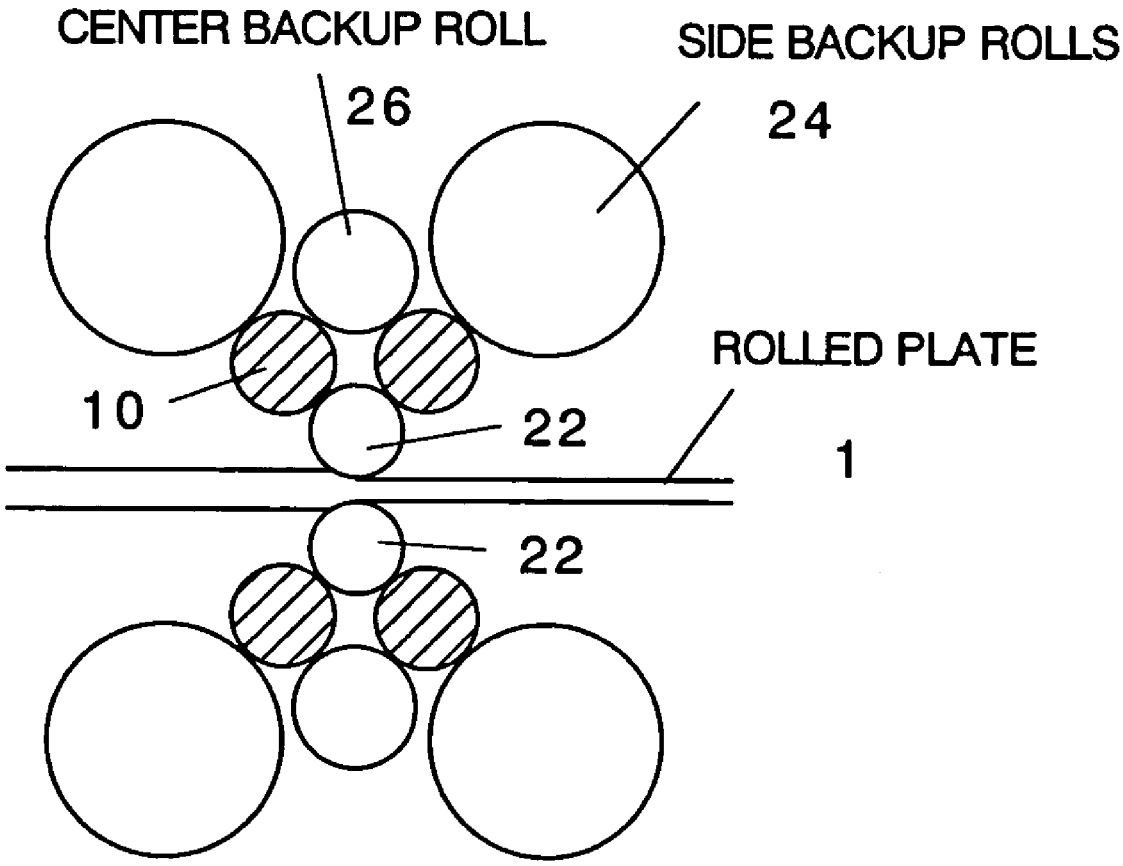
FIG. 7 shows an entire view of a second embodiment of the plate rolling mill according to the present invention.

The plate rolling mill according to the present invention is a six-roll mill or a cluster mill, and intermediate rolls 10 are preferably those for a six-roll mill or cluster mill. That is, in the case of a six-roll mill, corresponding to a pair of work rolls 22, a pair of backup rolls 24 and a pair of intermediate rolls 10 are used. Conversely, in the case of a cluster mill, as shown typically in FIG. 7, for a pair of work rolls 22, two or more pairs of backup rolls 24, and two or more pairs of intermediate rolls 10 (hatched) are used. In FIG. 7, 26 represents center backup rolls.

The case of a six-roll mill is described below according to FIG. 5. The following description also covers the case of a cluster mill. In FIG. 5, each intermediate roll is formed to be axially shiftable by means of a roll shift means, although this is not illustrated. In addition, at both ends of an intermediate roll 10, an intermediate roll bending means (not illustrated) is equipped to apply a bending moment 16. In this example, a work roll bending means (not illustrated) is also provided to apply bending moments 23 to both ends of work rolls 22.

Conventional mechanisms of means of roll shifting, intermediate roll bending and work roll bending may be used without modifications.

Each of work rolls 22 in the pair with a cylindrical roll having a rather small diameter that can appropriately catch and pull in plate material 1, with a relatively small toughness against bending, and the axis thereof is bent along the profile of the intermediate roll 10. The profile of work rolls 22 can be controlled slightly by the work roll bending means.

The backup roll 24 is the cylindrical roll with a comparatively large diameter, supported at both ends thereof by a support shaft 24*a* with a relatively large toughness to bending. Therefore, the roll contacts the intermediate roll 10 near convex center 15 of the intermediate roll 10 with a high facial pressure, thereby the roll bends the axis of the intermediate roll 10 and deforms the profile of the roll 10. Broken lines in FIG. 5 show the profiles of contact roll portions 12.

FIG. 5 shows a state in which convex centers 15 of upper and lower intermediate rolls are shifted in the direction that brings both rolls closer. Because the contact roll portion 12 of the intermediate roll 10 is convex shaped with the convex center 15 being positioned close to the extension barrel side, plate 1 can be controlled in the direction that makes the plate 1 thinner at the center portion than at the edge portions by shifting the intermediate rolls 10 in the directions of bringing the convex centers 15 of the upper and lower intermediate rolls 10 close to each other, as shown in FIG. 5.

FIG. 6 shows the state in which conversely to the above, convex centers 15 of upper and lower intermediate rolls are shifted in the directions such that both centers 15 are kept away from each other. Plate 1 can also be controlled in the direction to have a convex crown shape in the lateral section by shifting convex centers 15 of upper and lower intermediate rolls away from each other as shown in FIG. 6.

Also provided is extension barrel portion 13, which is connected to one end of the contact roll portion 12, and is not in contact with the backup roll at any shifted position, so plate crowns can be effectively controlled during rolling by means of roll bending 16.

Consequently, the basic settings are determined previously by shifting intermediate rolls, the rolling crown of the plate is controlled by roll bending, thus variations of plate crown during rolling can be controlled.

In addition, because intermediate rolls are configured to be shiftable, the rolled shape of the plate can be controlled by shifting intermediate rolls without shifting work rolls, so an additional effect is that the rolled plate is protected from being flawed, more efficiently than provided by conventional methods.

However, the present invention is not limited only to the aforementioned embodiments, it can of course be modified without departing from the scope of the present invention.

The invention claimed is:

1. A plate rolling mill comprising:

a pair of work rolls that hold and press down a plate material therebetween;

a plurality of backup rolls that prevent the work rolls from being deformed; and intermediate rolls each of which is disposed between the work roll and the backup roll so as to be shiftable to a plurality of shifted positions in axial directions thereof, characterized in that each of the intermediate rolls comprises:

a contact roll portion that contacts with the backup roll; and an extension barrel portion that is connected to an end of the contact roll portion, is disposable so that a fraction thereof faces the backup roll at at least one shifted position, and does not contact the backup roll at any shifted position, wherein the contact roll portion is formed to have a convex shape such that a convex center of the contact roll is positioned at a side of the extension barrel portion, and a diameter of each of the intermediate rolls changes in accordance with an axial distance from an axial end thereof in at least partial axial range thereof, and a ratio of an increase amount of the diameter to an increase amount of the axial distance discontinuously increases at a boundary where a position shifted by the axial distance from the axial end transfers from a position on the extension barrel portion to a position on the contact roll portion by increasing the axial distance.

2. The plate rolling mill according to claim 1, further comprising work roll bending means for applying a bending moment to both ends of the work rolls.

3. The plate rolling mill according to claim 1, further comprising work roll bending means for applying a bending moment to both ends of the intermediate rolls.

4. The plate rolling mill according to claim 1, wherein the intermediate rolls are intermediate rolls for a six-roll mill or a cluster mill.

5. The plate rolling mill according to claim 1, wherein the extension barrel portion has a truncated cone profile.

6. The plate rolling mill according to claim 1, wherein the contact roll portion includes a lateral center axis, wherein the convex center of the contact roll portion is disposed between the lateral center axis and the extension barrel portion.

7. A plate rolling mill comprising:

a pair of work rolls that hold and press down a plate material therebetween;

a plurality of backup rolls that prevent the work rolls from being deformed; and intermediate rolls each of which is disposed between the work roll and the backup roll so as to be shiftable to a plurality of shifted positions in axial directions thereof, characterized in that each of the intermediate rolls comprises:

a contact roll portion that contacts with the backup roll; and an extension barrel portion that is connected to an end of the contact roll portion, is disposable so that a fraction thereof faces the backup roll at at least one shifted position, and does not contact the backup roll at any shifted position, wherein the contact roll portion is formed to have a convex shape such that a convex center of the contact roll is positioned at a side of the extension barrel portion, and wherein the contact roll portion includes a lateral center axis, wherein the convex center of the contact roll portion is disposed between the lateral center axis and the extension barrel portion.

8. The plate rolling mill according to claim 7, wherein the extension barrel portion has a truncated cone profile.

* * * * *